US005617611A

United States Patent [19]

Wörwag

[11] Patent Number: 5,617,611

[45] Date of Patent: Apr. 8, 1997

[54] SUCTION LINE ASSEMBLY

[75] Inventor: Peter Wörwag, Romanshorn, Switzerland

[73] Assignee: Firma Fedag, Romanshorn, Switzerland

[21] Appl. No.: 680,123

[22] Filed: Jul. 15, 1996

[30] Foreign Application Priority Data

Jul. 15, 1995 [DE] Germany ..... 19525796.0

[51] Int. Cl.[6] ..... A47L 5/32

[52] U.S. Cl. ..... 15/331; 15/323; 15/335; 15/347; 15/352; 15/410; 285/7; 285/272

[58] Field of Search ..... 15/331, 334, 335; 285/7, 272

[56] References Cited

U.S. PATENT DOCUMENTS

| | | | |
|---|---|---|---|
| 1,514,276 | 11/1924 | Whalen et al. | 285/272 X |
| 1,887,600 | 11/1932 | Replogle | 15/335 |
| 2,175,642 | 10/1939 | Replogle | 15/334 |
| 3,239,244 | 3/1966 | Leinfelt | 285/7 |
| 3,588,945 | 6/1971 | Krier et al. | 15/354 X |
| 4,211,438 | 7/1980 | Asberg | 285/7 |
| 4,905,341 | 3/1990 | Sunagawa et al. | 15/331 X |
| 5,440,781 | 8/1995 | Kitazawa et al. | 15/344 |

FOREIGN PATENT DOCUMENTS 0621003 10/1994 European Pat. Off. .

*Primary Examiner*—Chris K. Moore
*Attorney, Agent, or Firm*—Robert W. Becker & Associates

[57] ABSTRACT

A suction line has a stiff suction tube and a flexible suction hose having a connecting end. A connector for connecting the connecting end of the flexible suction hose to the stiff suction tube to form the suction line having free ends is provided. One of the free ends of the suction line is connected to a vacuum source. The other free end of the suction line can receive a vacuuming tool. The stiff suction tube has a longitudinal axis. The connector is rotatable about an axis extending transverse to the longitudinal axis.

15 Claims, 9 Drawing Sheets

SUCTION LINE ASSEMBLY

BACKGROUND OF THE INVENTION

The present invention relates to a suction line assembly comprised of a substantially stiff suction tube and a flexible suction hose whereby one end of the suction hose is connected to the suction tube and one free end of the suction line is connected to a vacuum source and the other end of the suction line is connectable to a vacuuming tool.

In vacuum cleaning devices flexible suction hoses are used together with stiff suction tubes as suction lines whereby the suction hose is axially inserted into the suction tube. The suction tube serves for guiding the vacuum cleaning device while the flexible suction hose is designed to ensure a substantially unobstructed vacuuming movement relative to the vacuum cleaning device.

When the vacuum cleaning device is to be shut off, the suction line must in most cases be disassembled in order to reduce the storage space required for the vacuum cleaning device.

It is therefore an object of the present invention to provide a suction line assembly comprised of an essentially stiff suction tube and a flexible suction hose designed such that, on the one hand, a high degree of movability during vacuuming and, on the other hand, a small storage space, when not in use, is ensured.

SUMMARY OF THE INVENTION

The inventive suction line is primarily characterized by:

A stiff suction tube;

A flexible suction hose having a connecting end;

A connector for connecting the connecting end of the flexible suction hose to the stiff suction tube to form the suction line having free ends;

One of the free ends of the suction line connected to a vacuum source;

The free end of the suction line having means for receiving a suction tool;

The stiff suction tube having a longitudinal axis;

The connector being rotatable about an axis extending transverse to the longitudinal axis.

Preferably, the axis of rotation is perpendicular to the longitudinal axis.

Advantageously, the axis of rotation intercepts the longitudinal axis.

The connector is preferably rotatable about an angle of 360° and beyond.

Advantageously, the suction line further comprises a cylindrical housing connected to the stiff suction tube, wherein the connector is rotatably connected to the cylindrical housing.

Advantageously, the cylindrical housing comprises a separator for coarse dust particles entrained in a suction stream generated by the vacuum source.

Preferably, the cylindrical housing has a center axis and the flexible suction hose opens into the cylindrical housing coaxially to the center axis.

Preferably, the cylindrical housing has a center axis and the flexible suction hose opens into the cylindrical housing in a radial direction relative to the center axis.

Expediently, the connector has a connecting member and the connecting end of the flexible suction hose is detachably connected to the connecting member.

Preferably, the stiff suction tube opens radially into the cylindrical housing.

Preferably, the stiff suction tube opens into the cylindrical housing in the direction of a secant at the cylindrical housing.

In a further embodiment of the present invention, the flexible suction hose has a mouth opening into the cylindrical housing and the cylindrical housing comprises a filter element covering the mouth.

Advantageously, the stiff suction tube and the flexible suction hose extends substantially parallel to one another.

Advantageously, the stiff suction tube is a telescoping tube.

The stiff suction tube preferably forms a guide rod for the vacuum cleaner.

The suction tube and the facing end of the suction hose are connected transverse to their longitudinal axis relative to one another whereby the connector of the suction hose is rotatable about an axis of rotation which extends transverse to the longitudinal axis of the suction tube. In this design, on the one hand, the flexibility of the suction hose for achieving high movability is used, and, on the other hand, due to the movable connection between the suction hose and the suction tube an additional degree of freedom is provided which allows a high movability without obstruction by the suction hose or the vacuum cleaning device. Due to the rotatability of the connector the suction hose can be simply pivoted into a position parallel to the suction tube so that without demounting of the hose a space-saving arrangement can be achieved.

Preferably, the connection between the suction hose and the suction tube can be achieved with a housing the interior of which provides a separator for coarse dirt particles entrained within the suction air stream. This lowers the loading of the dust receptacle, respectively, the dust filter within the vacuum cleaning device and also avoids mechanical damage caused by large dirt particles.

In a preferred embodiment of the invention the end of the suction hose facing the suction tube is detachably inserted into a connecting socket of the connector. Thus, without difficult mounting and demounting steps, one end of the suction hose can be used as a nozzle for upholstery vacuuming, which end is insertable into the connecting socket of the connector when the suction tube is to be used for this vacuuming application. After removal from the connector, the free end of the suction hose can be used as a nozzle for upholstery vacuuming.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 12.

Figure 1:
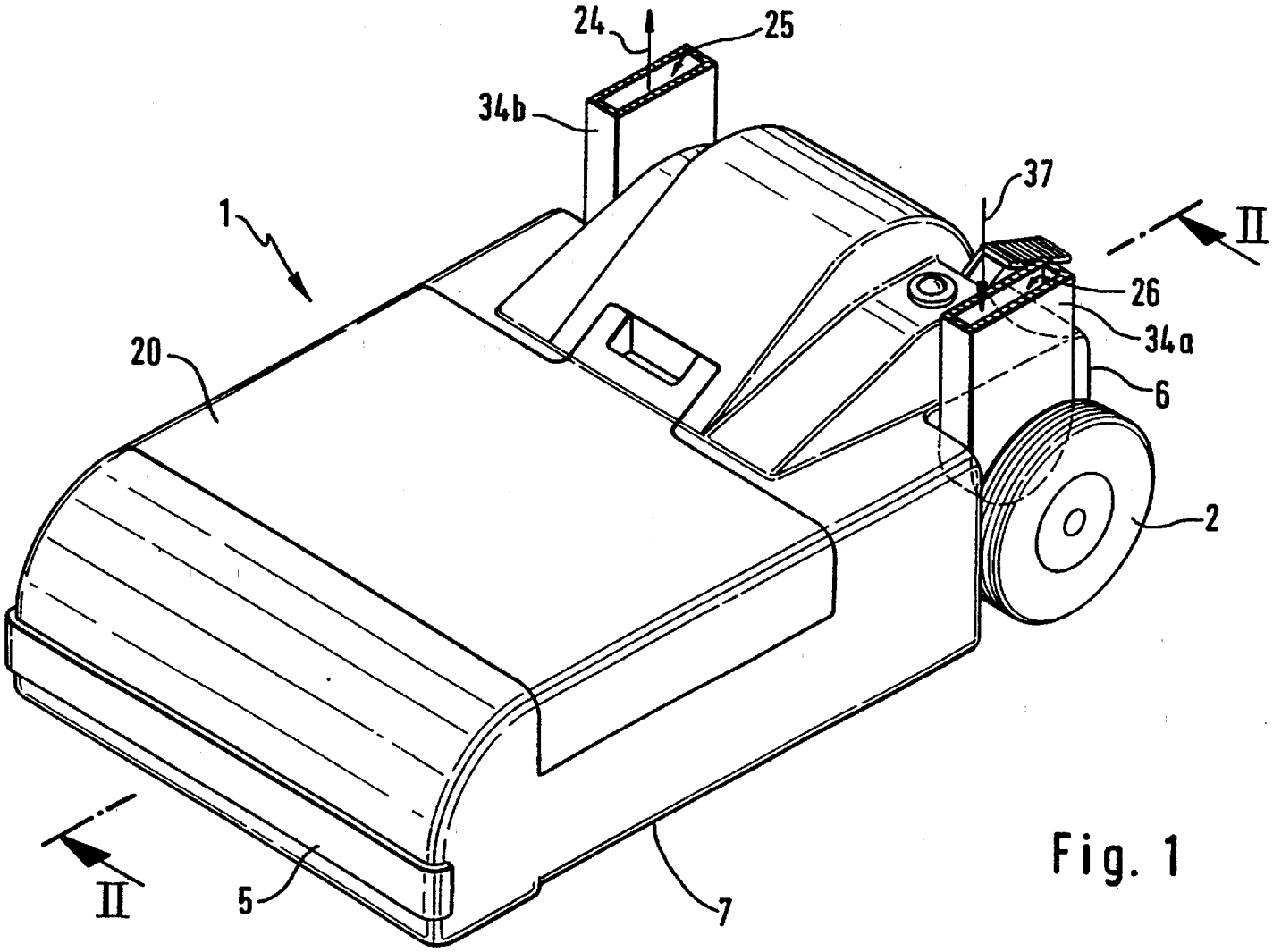
FIG. 1 is a schematic representation of a perspective view of the inventive vacuum cleaning device.
Figure 2:
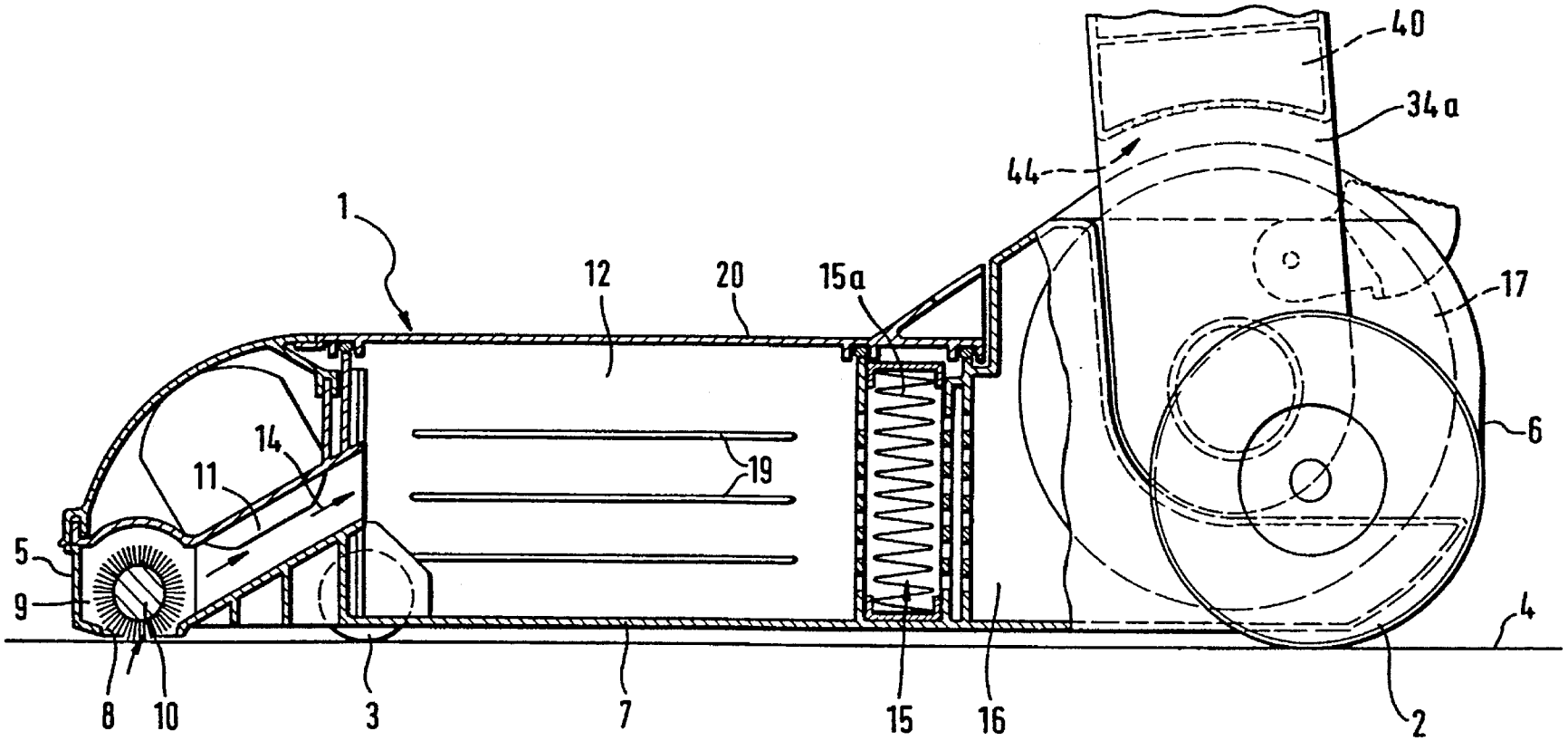
FIG. 2 is a section of the vacuum cleaning device along the section line II—II of FIG. 1.
Figure 3:
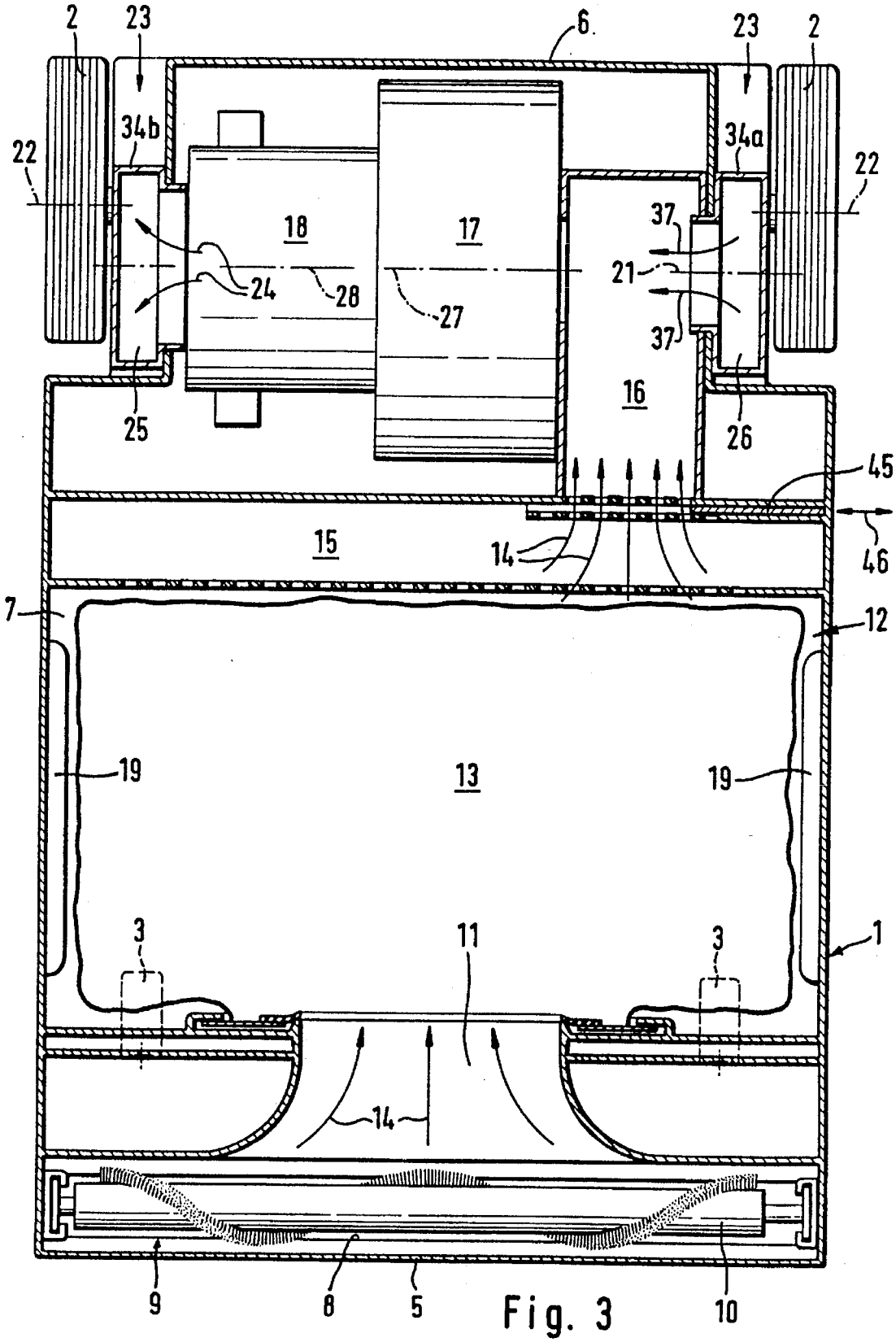
FIG. 3 is a plan view of the open vacuum cleaning device, partly in section.

The vacuum cleaning device represented in the drawings comprises a vacuum cleaning tool with a tool housing 1 which is supported with casters 2, 3 so as to be movable across the floor 4. As can be seen in the drawings of FIGS. 1 to 3, the tool housing 1 has a substantially rectangular shape whereby in the area of the leading narrow side 5 the bottom plate 7 of the tool housing 1 is provided with a suction slot 8 which extends parallel to the narrow side 5 approximately over the entire width of the housing 1. The suction slot 8 opens into a brush chamber 9 in which a brush roller 10 is rotatably supported. The bristles of the brush roller 10 project through the suction slot 8 onto the floor 4. The brush roller 10 is driven by a suitable drive unit, preferably with a belt drive. The drive unit may be an electric motor or may also be an air turbine which is driven by the suction air stream.

The brush chamber 9 communicates via a flow channel 11 with a receiving chamber 12 containing a dust receptacle 13. Preferably, the flow channel 11 opens directly into the dust receptacle 13 which is positioned in the receiving chamber 12. The flow channel 11 tapers in flow direction of the incoming air stream 14 and ascends from the brush chamber 9 to about half the height of the receiving chamber 12. The receiving chamber 12 is connected to the suction side 16 of the suction blower 17, preferably via a fine filter chamber 15. The blower 17 is driven by a drive unit 18, in the shown embodiment an electric motor. The outgoing air stream 24 exiting the blower 17 is guided through the exit channel 25. As is shown in FIG. 2, a filter 15*a* can be provided in the fine filter chamber 15 for an after filtering of the incoming air stream 14, whereby the filter 15*a* is preferably a folded filter.

In operation of the vacuum cleaning device the brush roller 10 rotates and brushes the surface to be cleaned whereby loosened dirt, dust etc. is entrained by the incoming air stream 14 entering the vacuum cleaning device through the suction slot 8. The incoming air stream 14 is guided via the ascending flow channel 11 directly into the dust receptacle 13 and exits through its air-permeable walls into the receiving chamber 12. After passing through the fine filter 15*a* within the fine filter chamber 15 the incoming air stream 14 enters via the suction side 16 the suction blower 17 and is guided via the exit channel 25 as outgoing air stream 24 away from the blower. In order for the dust receptacle 13, which in general is a paper container etc., to be uniformly subjected over its entire surface area to the incoming air stream, the receiving chamber 12 is provided with spacer ribs 19 so that it is ensured that the vacuum produced within the receiving chamber 12 acts over the entire surface area of the dust receptacle 13. When the dust receptacle 13 is full, lid 20 is removed after shutting off the blower 17 and the dust receptacle 13 can be replaced.

Figure 5:
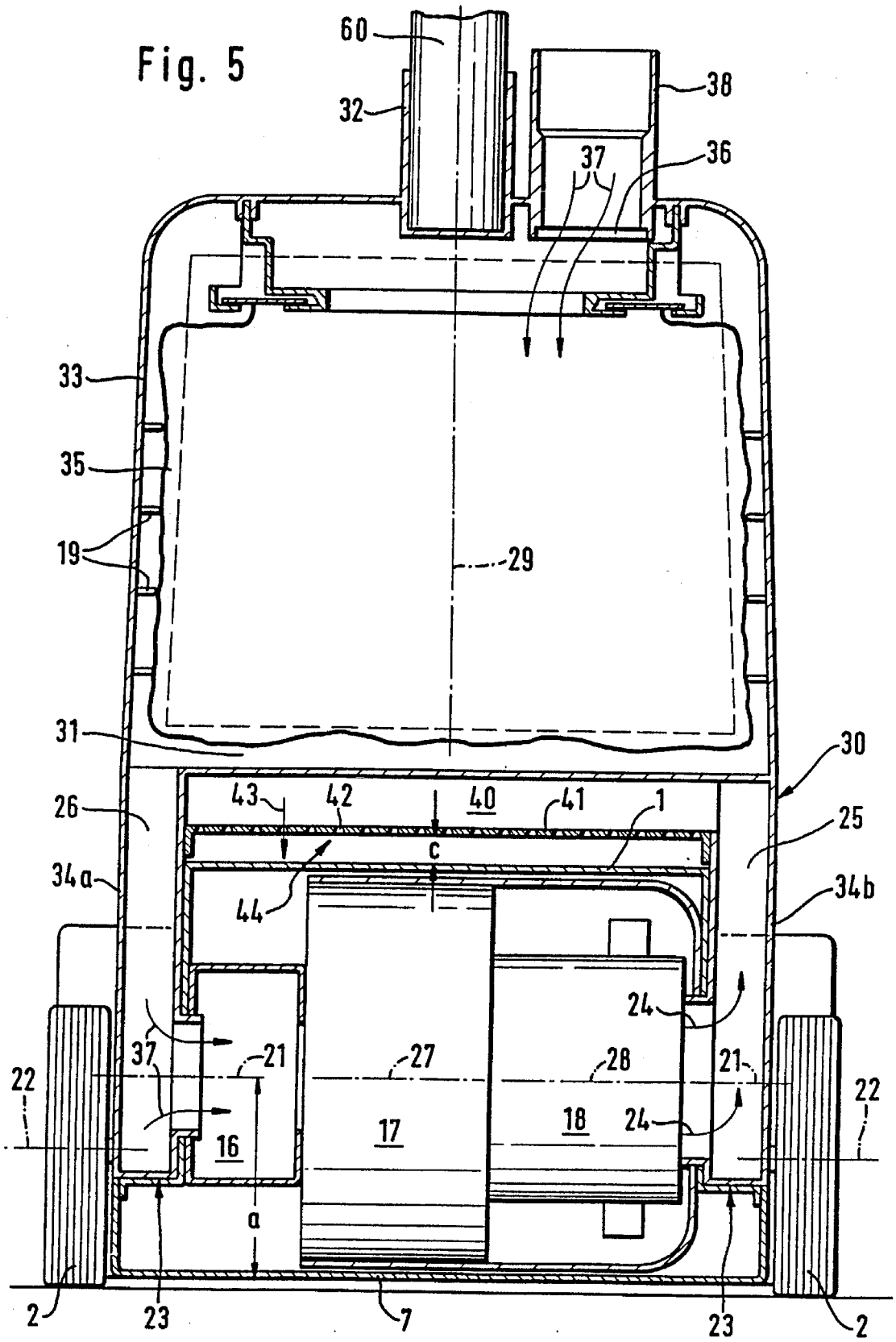
FIG. 5 is an end view of the open housing of the vacuum chamber and the exit chamber.

In parallel flow connection to the receiving chamber 12 the suction side 16 of the suction blower 17 is connected to a vacuum chamber 31 which is provided in a housing 33 at the guide rod of the vacuum cleaning device. As can be seen especially in FIG. 5, in the shown embodiment the housing 33 is essentially the lower portion of the guide rod 60. In the area of the rearward narrow side 6 of the housing 1 of the vacuum cleaning tool, the housing 33 of the vacuum chamber 31 is provided with a fork member 30 which is preferably a unitary part of the housing 33. The fork member 30 bridges the vacuum cleaning device and is pivotably mounted at the housing 1 of the vacuum cleaning tool. The pivot axis of the fork member 30 coincides with the axis of rotation 27 of the suction blower 17. Preferably, the axis of rotation 28 of the drive unit 18 also coincides with the pivot axis 21. As shown in FIG. 5, the pivot axis 21 of the fork member 30 is positioned at a greater distance a to the bottom plate 7 than the axis of rotation 22 of the rear casters 2 arranged at the vacuum cleaning device. The hollow fork legs 34*a*, 34*b* engage preferably gaps 23 between the rear casters 2 and the housing 1. The hollow fork leg 34*a* forms the suction channel 26 for the vacuum chamber 31 and the hollow fork leg 34*b* forms the exit channel 25.

Figure 4:
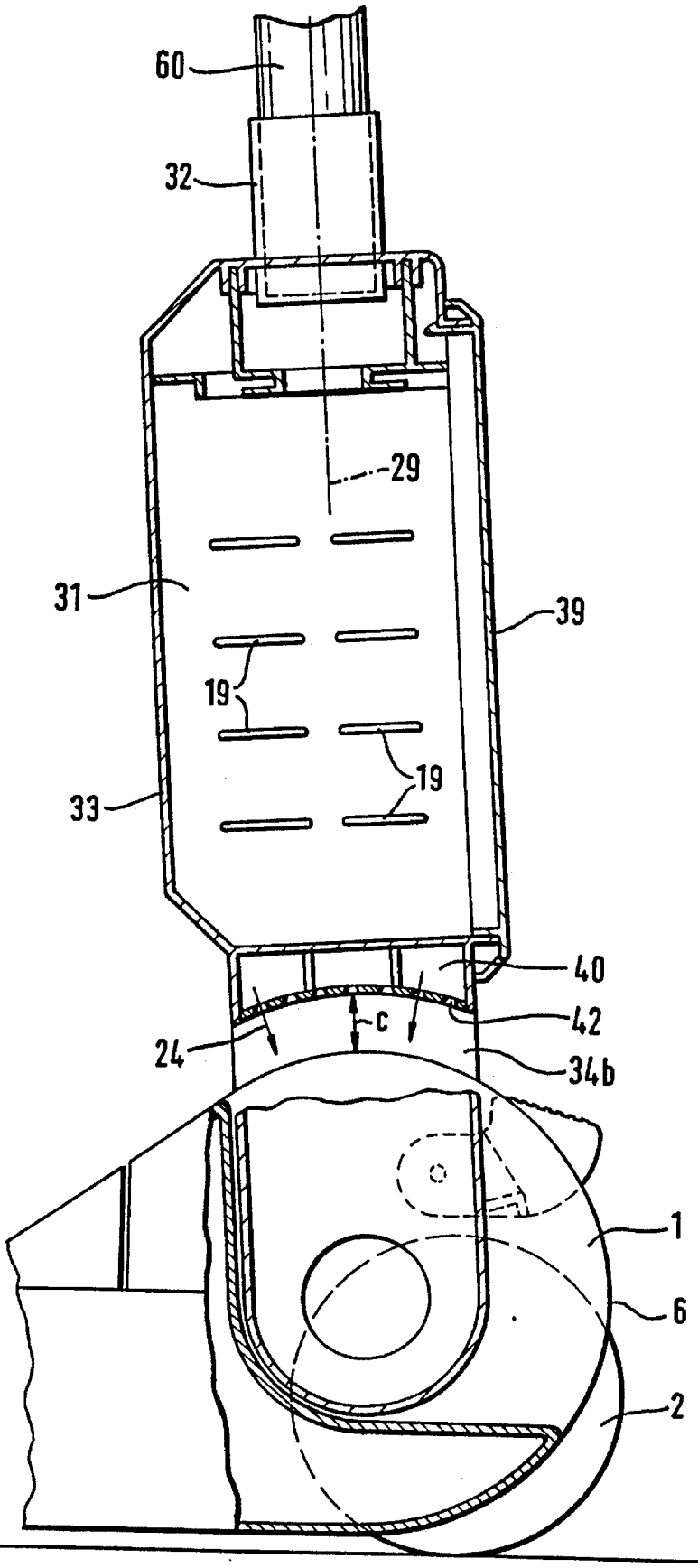
FIG. 4 is a section of the housing for a vacuum chamber and an exit chamber connected to the guide rod of the vacuum cleaning device.

As is shown in FIGS. 4 and 5, the fork legs 34*a* and 34*b* in the area of the pivot axis 21 are provided with an opening facing the housing 1 via which the hollow fork leg 34*a* is connected to the suction side 16 of the suction blower 17 and the fork leg 34*b* to the pressure side. The hollow fork leg 34*b* guides the outgoing air stream into the exit chamber 40 which extends over the inner width of the fork member 30 in the area of the center stay connecting the fork legs 34*a*, 34*b*. The exit chamber 40 is preferably embodied together with the vacuum chamber 31 within the housing 33. The exit chamber 40 is delimited by the fork member 30 and a perforated wall 41 which forms the outlet opening 44 and which faces the housing 1 of the vacuum cleaning tool. The perforated wall 41 provides the outlet opening for the exit chamber 40 whereby the individual holes 42 widen in the direction of the outflowing air stream so that an expansion of the exiting air stream and thus a noise level reduction is achieved. The perforated wall 41 of the exit chamber 40 is a cylindrical wall section having an imaginary cylinder axis that coincides with the pivot axis 21. The perforated cylindrical wall section 41 thus surrounds the housing 1 at a distance c (FIG. 4). During operation and movement of the vacuum cleaning device, the housing 33 secured at the guide rod 60 is pivoted relative to the housing 1 of the vacuum cleaning tool about the axis 21 so that the exit air stream 24 impacts always different wall portions of the housing 1. This reduces vibrations which would increase the noise level at the exit side in a reliable manner.

The other hollow fork leg 34*a* connects the vacuum chamber 31 with the suction side 16 of the blower 17. The receiving chamber 12 for the dust receptacle 13 and the vacuum chamber 31 are thus flow-technologically connected in parallel to one another.

The vacuum chamber 31 comprises a suction air inlet 36 which is formed by a connecting socket 38. Coinciding with the longitudinal center axis 20 of the housing 33 a cup-shaped bushing 32 for securing the guide rod 60 is provided at the housing wall. The connecting socket 38 is preferably adjacent to and parallel to the bushing 32.

In the vacuum chamber 31 a dust receptacle 35 is inserted into which the suction air stream 37 enters directly through the suction air inlet 36. For replacing the dust receptacle 35 (FIG. 5) the housing 33 can be opened by removing a lid 39 (FIG. 4) which forms the back wall of the rectangular housing 33.

The connection of the vacuum chamber 31 to the suction side 16 of the suction blower 17 with the hollow fork leg 34*a* is a technically elegant solution since the connection to the suction side 16 is provided in the area of the pivot axis 21 so that a simple and reliable connection is achieved. Since the fork legs 34*a*, 34*b* are supported in bearings through which the respective air stream is guided, the otherwise required flexible hose sections for bridging the movement gap between the parts movable relative to one another are thus obsolete.

Figure 6:
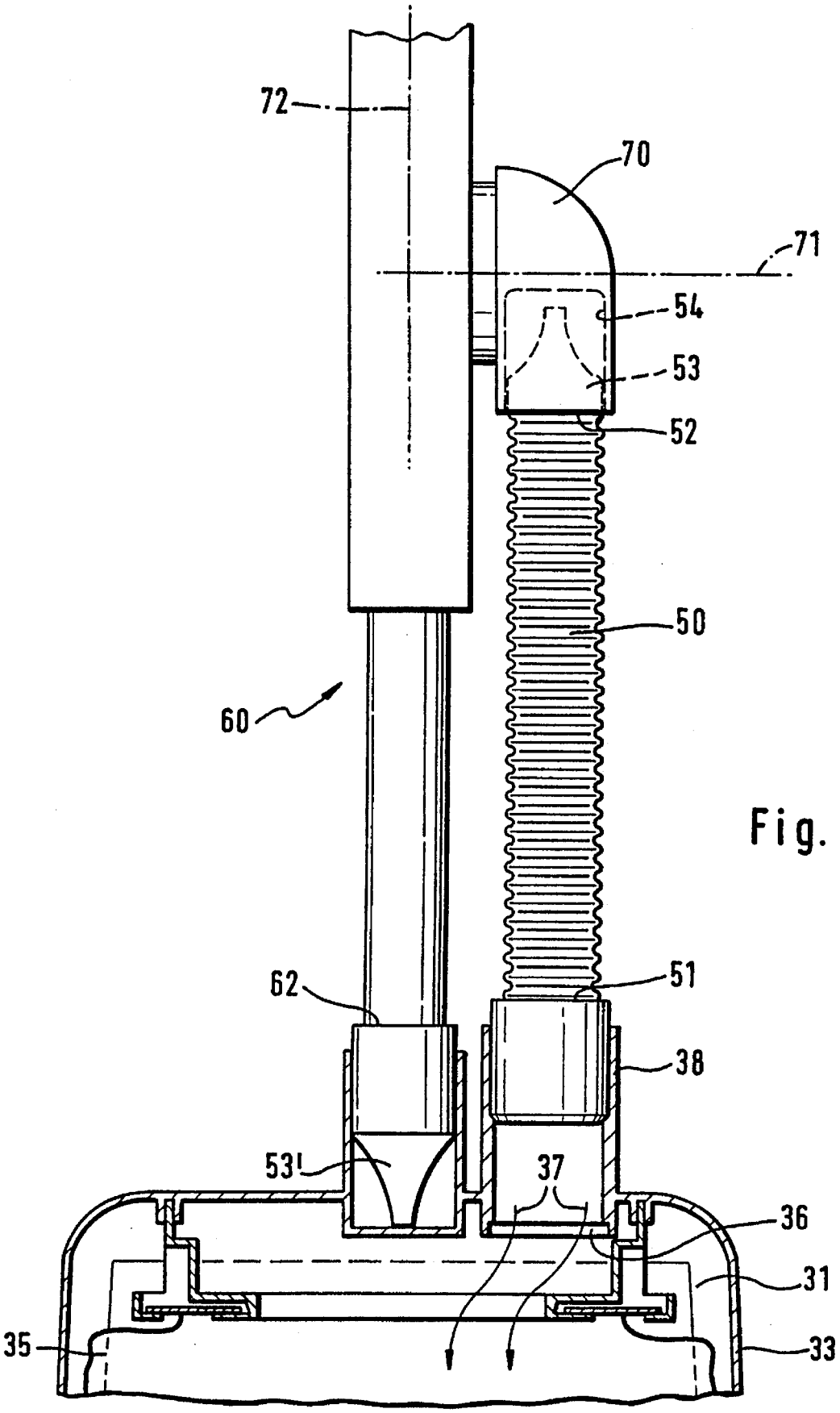
FIG. 6 is a schematic representation of a suction line connected to the suction air inlet of the vacuum chamber.

FIG. 6 shows an embodiment of securing a suction hose 50. One end 51 of the suction hose 50 is inserted substantially air-tightly into the connecting socket 38 of the suction inlet opening 36. The other end 52 of the suction hose 50 is connected to the guide rod 60 which at one end supports a handle 61 and with its other end 62 is fixedly inserted into the cup-shaped bushing 32 which is closed off relative to the vacuum chamber 31. The hose end 52 be provided with a vacuuming tool 53. The hose end 52, when not in use, is substantially air-tightly inserted into receiving member 54 so that the hose 50 is air-tightly closed off. Expediently, the hose 50 extends parallel to the guide rod 60. Since the vacuum chamber 31 is permanently connected to the suction side 16 of the suction blower 17, during operation of the vacuum cleaning device a vacuum will be produced within the vacuum chamber 31. This vacuum also acts via the suction air inlet 36 within the hose 50, the end 52 of which, when not in use, is inserted into the receiving member 54 so as to be substantially air-tightly sealed off. The vacuum results in a stiffening of the hose 50 which thus extends, without presenting an obstacle to the operator, parallel and substantially stiff adjacent to the guide rod 60.

The permanent connection of the vacuum chamber 31 to the suction side 16 thus does not impede handling of the vacuum cleaning device. Only during start-up of the vacuum cleaning device it may be observed that the suction air stream 14 is slightly weakened at the suction slot 8. As soon as the vacuum chamber 31 is evacuated, the suction air stream 14 is available in full force at the suction slot 8. Possibly occurring leaks at the ends 51 and 52 of the suction hose 50 are negligible.

When vacuuming operations are performed with the hose 50 connected to the suction air inlet 36, an undesirable decrease of the suction output at the hose may occur due to the incoming suction air stream 14 still generated at the suction slot 8. Expediently, a slide closure 45 is thus provided within the housing 1 between the suction side 16 and the suction slot 8 which can be moved in the direction of double arrow 46. In the shown embodiment, the slide closure 45 is arranged at the suction opening of the fine filter chamber 15. When the slide closure 45 is in the closed position, the suction blower 17 sucks in air exclusively via the vacuum chamber 3. Thus, the total vacuum output is available.

Preferably, the guide rod 60 is embodied as a suction tube 60*a* at least in the area parallel to the suction hose 50 so that the suction hose 50 with its end 52 can be fixedly connected to the guide rod 60 embodied as a suction tube. Preferably, the end 52 of the suction hose 50 is connected with a connector 70 to the suction tube 60*a* of the guide rod 60 whereby the suction hose 50 opens transverse to the longitudinal axis 72 of the suction tube 60*a* into the suction tube 60*a* of the guide rod 60. The connector 70 is preferably rotatable about an axis of rotation 71 transverse to the longitudinal axis 72 of the suction tube 60*a*. It is preferably rotatable about a rotation angle 74 of 360° and beyond (i.e., there is no abutment hindering free rotation). The axis of rotation 71 is positioned perpendicular to the longitudinal axis of the suction tube. Preferably, the axis of rotation 71 intercepts the longitudinal axis 72 of the suction tube 60*a*.

When the guide rod is embodied as a suction tube, the end 62 may have connected thereto a vacuuming tool 53'. The end 62 of the guide rod 60 is then inserted into the blind bushing 32 substantially in an air-tight manner so that, on the one hand, a secure guiding of the vacuum cleaning device with the guide rod is ensured and, on the other hand, after removal of the guide rod 60 from the bushing 32, vacuuming operations with the stiff suction tube 60*a* can be performed. This allows for a free movability because, on the one hand, the suction hose 50 is flexible and, on the other hand, due to the free rotatability of the connector 70 about the axis of rotation 71, a relative movement between the suction tube 60*a* of the guide rod 60 and the connector 70 is possible.

Figure 9:
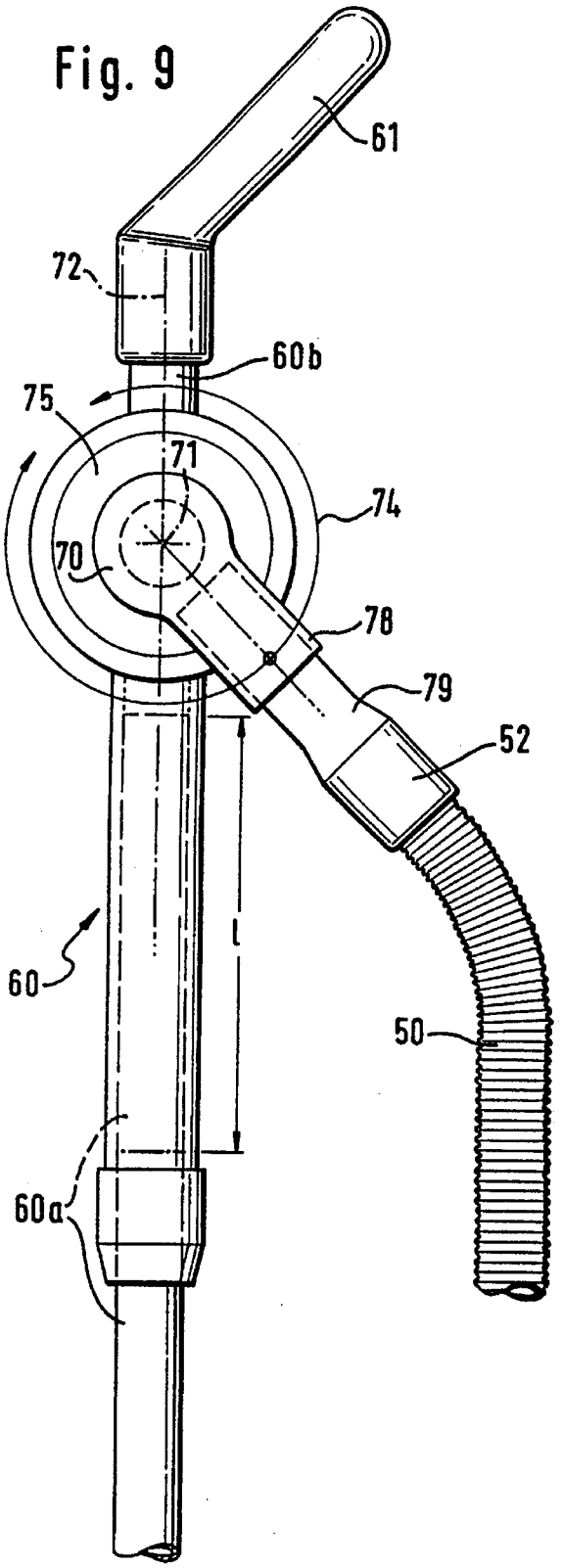
FIG. 9 is a representation of a connection between the suction hose and the suction tube similar to the representation of FIG. 7 with a hose end that is detachably connected to a connector.
Figure 10:
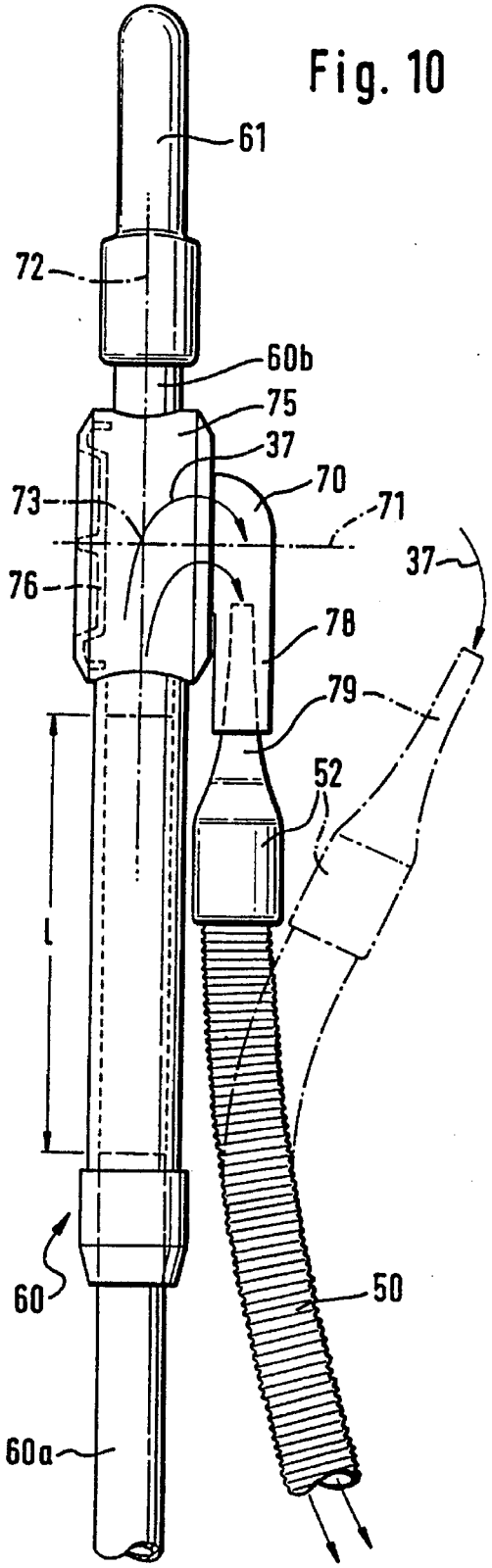
FIG. 10 is a side view of the connection of FIG. 9.

In order to provide a length adjustment of the guide rod 60 to the height of different operators using the vacuum cleaning device and to provide an adaptation to different uses, the guide rod 60, especially the portion that is embodied as a suction tube 60*a*, is a telescoping tube with a maximum extension length I (FIGS. 9, 10).

Figure 7:
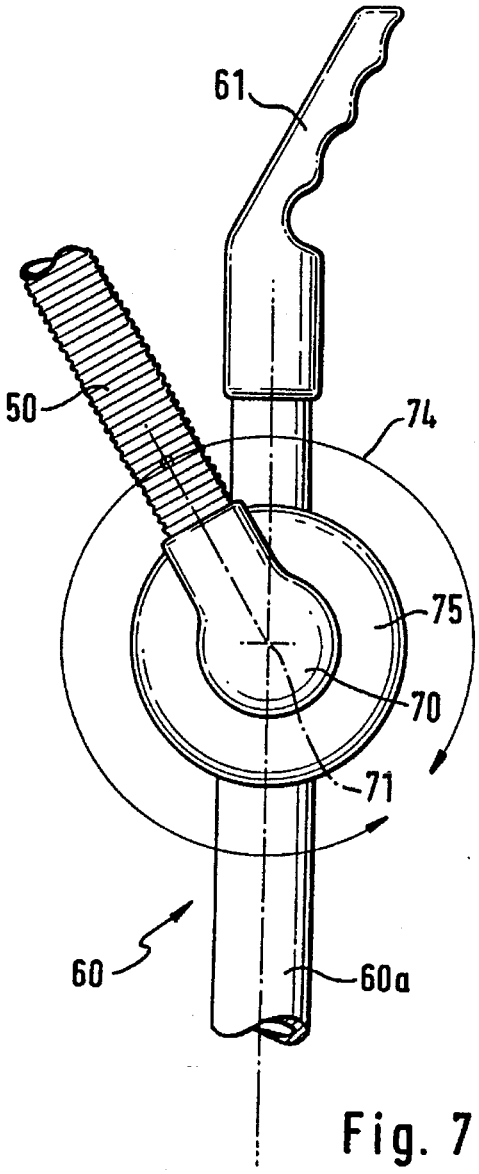
FIG. 7 is a plan view of the connection between the suction hose and the suction tube of the suction line.
Figure 8:
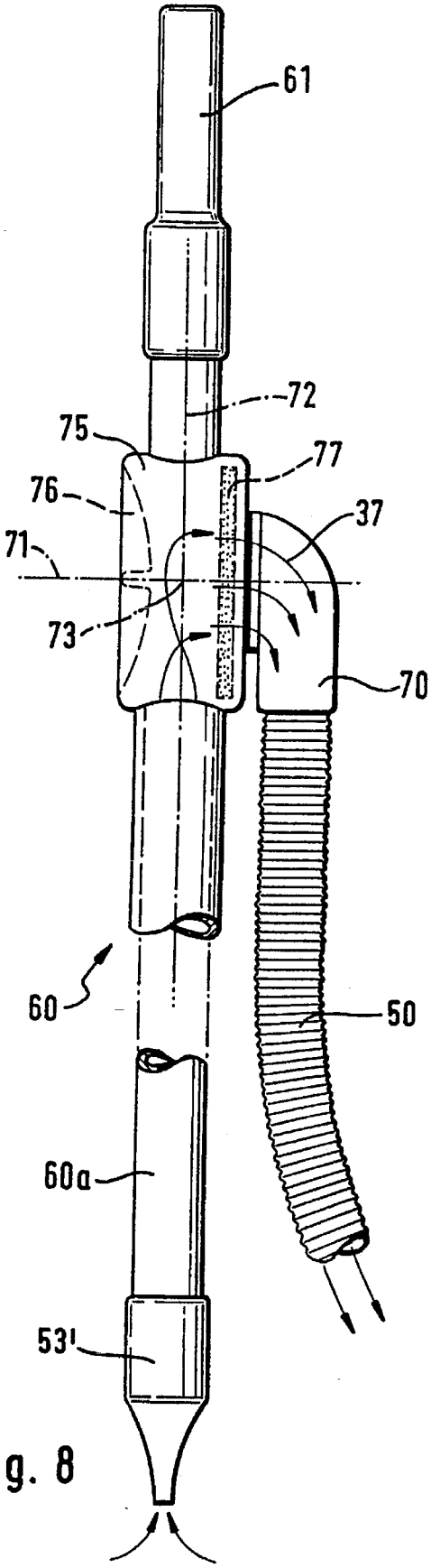
FIG. 8 is a side view of the connection according to FIG. 7.

In FIGS. 7 and 8 an embodiment of a connection of a hose 50 to a guide rod 60 embodied as a suction tube is shown. In the upper section of its length, the guide rod 60 is provided with a cylindrical housing 75 which is radially penetrated by the guide rod 60. In the shown embodiment, the longitudinal center axis 72 of the guide rod 60 extends approximately through the center point 73 of the cylindrical housing 75. The section 60*a* of the guide rod 60 positioned between the housing 75 and the bushing 32 of the housing 33 is in the form of a suction tube 60*a* which opens into the housing 75. The end section 60*b* projecting from the housing 75 and supporting the handle 61 is air-tightly closed off relative to the housing 75.

The connector 70 opens transverse to the suction tube 60*a* into the housing 75. It is axially connected to the end face of the housing 75. The connector 70, as shown in FIG. 7, is rotatable about an angle of rotation 74 of 360° and beyond relative to the guide rod 60.

The axial end face of the housing 75 facing away from the connector 70 is a lid 76, as shown in the embodiments according to FIGS. 7 and 8. After opening the lid 76, the interior of the housing 75 is accessible. Preferably, in the housing 75 the opening or mouth of the connector 70 into the housing 75 is covered by a filter element 77. During vacuuming operations with the suction tube 60*a* of the guide rod 60, the housing 75 thus serves as a separator for coarse dirt particles entrained within the suction air stream 37.

The embodiment according to FIGS. 9 and 10 corresponds in its basic design to the embodiment of FIGS. 7 and 8. The housing 75 is a cylindrical body at one end face of which the connector 70 is rotatably supported so as to be rotatable about an angle of rotation 74 of 360° and more. The end face facing away from the connector 70 is in the form of a lid 76 and after removal of the lid 76 the coarse dirt particles collected within the housing 75 can be removed. In deviation from the embodiment according to FIGS. 7 and 8, the connector 70 is provided with an plug-in socket 78 into which a respectively adapted vacuuming tool 79 can be inserted which is preferably permanently connected to the end 52 of the suction hose 50. It is thus possible to perform vacuuming operations with the telescoping suction tube 60*a* of the guide rod 60 as well as with the vacuuming tool 79. The vacuuming tool 79 is preferably a nozzle for vacuuming upholstery.

Figure 11:
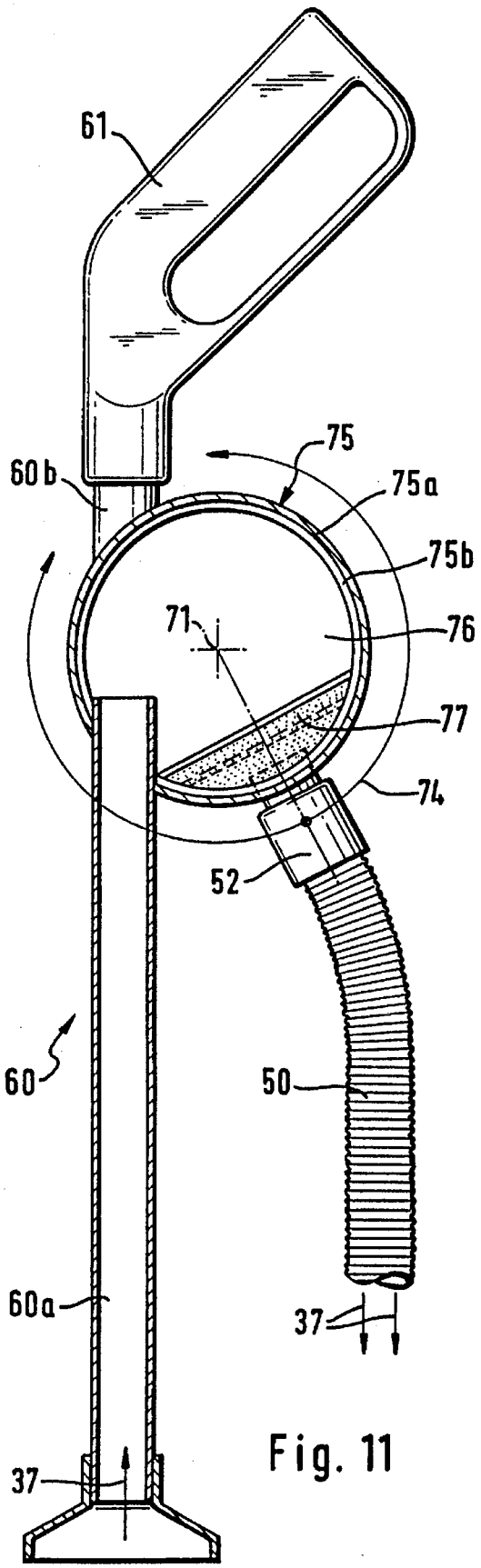
FIG. 11 is a further embodiment of a connection between a suction hose and a suction tube.
Figure 12:
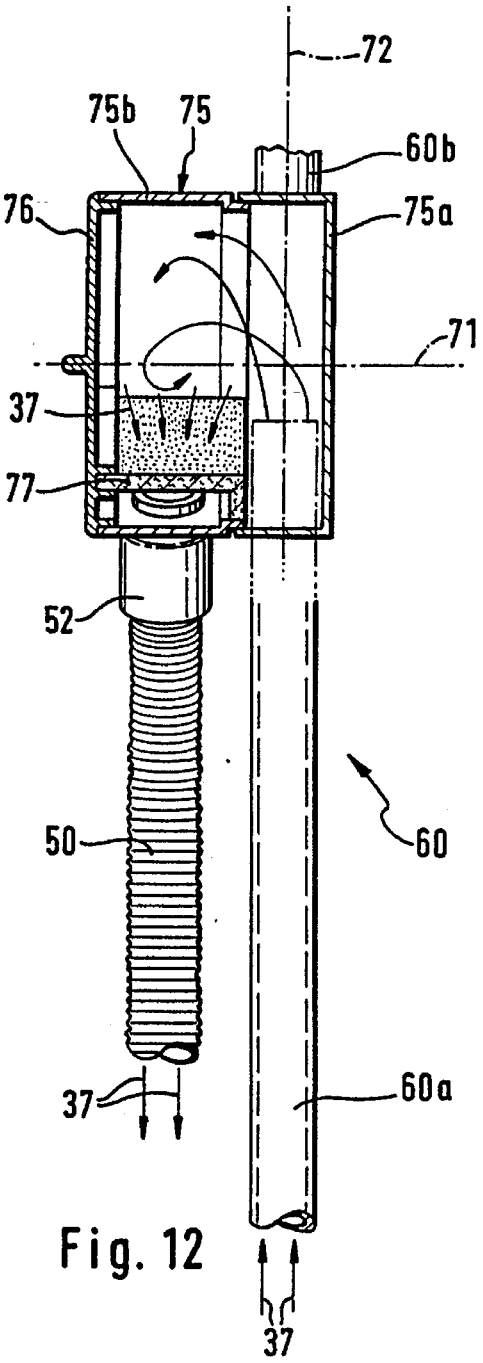
FIG. 12 is a side view of a section of the connection according to FIG. 11.

In the embodiment according to FIGS. 11 and 12 a cylindrical housing 75 is provided. The guide rod 60, respectively, the suction tube 60*a* and the end portion 60*b* supporting the handle 61, is however arranged as a secant at the circumference of the cylindrical housing 75. The housing 75 is comprised of two halves 75*a* and 75*b* (FIG. 12) whereby the half 75*b* is provided with the lid 76 forming one of the axial end faces. The housing halves 75*a*, 75*b* are rotatable relative to one another whereby the axis of rotation extends transverse to the longitudinal center axis 72 of the guide rod 60 but does not intercept this axis 72. The suction tube 60*a* of the guide rod 60 as well as the end 52 of the suction hose 50 open radially into the housing 75. The stiff suction tube 60*a* is positioned within the housing half 75*a* and the hose end 52 is positioned within the housing half 75*b*. Thus, in the housing 75 an air stream 37 is produced transverse to the longitudinal center axis 72 and the housing 75 again serves as a separator for coarse dirt particles entrained within the suction air stream. The opening (mouth) of the hose end 52 at the housing 75 is again covered by a filter element 77.

The present invention is, of course, in no way restricted to the specific disclosure of the specification and drawings, but also encompasses any modifications within the scope of the appended claims.

What I claim is:

1. A suction line comprising:

a stiff suction tube;

a flexible suction hose having a connecting end;

a connector for connecting said connecting end of said flexible suction hose to said stiff suction tube to form said suction line having free ends;

one of said free ends of said suction line connected to a vacuum source;

another of said free ends of said suction line having means for receiving a vacuuming tool;

said stiff suction tube having a longitudinal axis;

said connector being rotatable about an axis extending transverse to said longitudinal axis.

2. A suction line according to claim 1, wherein said axis of rotation is perpendicular to said longitudinal axis.

3. A suction line according to claim 2, wherein said axis of rotation intercepts said longitudinal axis.

4. A suction line according to claim 1, wherein said connector is rotatable about an angle of 360° and beyond.

5. A suction line according to claim 1, further comprising a cylindrical housing connected to said stiff suction tube, wherein said connector is rotatably connected to said cylindrical housing.

6. A suction line according to claim 5, wherein said cylindrical housing comprises a separator for coarse dust particles entrained in a suction stream generated by the vacuum source.

7. A suction line according to claim 5, wherein said cylindrical housing has a center axis and wherein said flexible suction hose opens into said cylindrical housing coaxially to said center axis.

8. A suction line according to claim 5, wherein said cylindrical housing has a center axis and wherein said flexible suction hose opens into said cylindrical housing in a radial direction relative to said center axis.

9. A suction line according to claim 5, wherein said connector has a connecting member and wherein said connecting end of said flexible suction hose is detachably connected to said connecting member.

10. A suction line according to claim 5, wherein said stiff suction tube opens radially into said cylindrical housing.

11. A suction line according to claim 5, wherein said stiff suction tube opens into said cylindrical housing in the direction of a secant at said cylindrical housing.

12. A suction line according to claim 5, wherein said flexible suction hose has a mouth opening into said cylindrical housing and wherein said cylindrical housing comprises a filter element covering said mouth.

13. A suction line according to claim 1, wherein said stiff suction tube and said flexible suction hose extend substantially parallel to one another.

14. A suction line according to claim 1, wherein said stiff suction tube is a telescoping tube.

15. A suction line according to claim 1, wherein said stiff suction tube forms a guide rod for a vacuum cleaner.

* * * * *